US005824955A

United States Patent [19]

Saiso et al.

[11] Patent Number: 5,824,955

[45] Date of Patent: Oct. 20, 1998

[54] CONNECTING STRUCTURE BETWEEN FLAT CABLE AND TERMINALS

[75] Inventors: Kenichi Saiso; Ken Tokunaga, both of Miyagi-ken, Japan

[73] Assignee: Alps Electric Co., Ltd., Japan

[21] Appl. No.: 784,612

[22] Filed: Jan. 21, 1997

[30] Foreign Application Priority Data

Jan. 23, 1996 [JP] Japan ..... 8-009347

[51] Int. Cl.[6] ..... H01R 4/02

[52] U.S. Cl. ..... 174/88 R; 439/874

[58] Field of Search ..... 174/84 R, 88 R; 439/874, 492, 499

[56] References Cited

U.S. PATENT DOCUMENTS 5,111,363 5/1992 Yagi et al. ..... 361/398

5,423,474 6/1995 Kanagawa et al. ..... 228/110.1

*Primary Examiner*—Bot L. Ledynh

*Assistant Examiner*—Marc D. Machtinger

*Attorney, Agent, or Firm*—Brinks Hofer Gilson & Lione

[57] ABSTRACT

A connecting structure between a flat cable and terminals is disclosed. In the structure, projections are formed on each of a plurality of terminals provided on a lead block, the terminals and a plurality of conductors of a flat cable are overlapped on an anvil of an ultrasonic welding apparatus, and ultrasonic vibrations are applied to overlapping portions of the terminals and the conductors while being pressurized by a horn, whereby solid-phase welding is caused between the projections of the terminals and the conductors, and a plurality of terminal and conductor pairs are simultaneously ultrasonically welded.

11 Claims, 2 Drawing Sheets

CONNECTING STRUCTURE BETWEEN FLAT CABLE AND TERMINALS

BACKGROUND OF THE INVENTION

1. Field of the Invention

The present invention relates to a connecting structure for ultrasonically welding conductors of a flat cable to mating terminals.

2. Description of the Related Art

A flat cable is a belt-shaped item comprised of a base film formed of polyethylene terephthalate (PET) carrying a conductor formed of copper foil or the like. For example, in a rotary connector used as a conducting means for an air bag circuit, the flat cable is stored in a pair of rotatably connected housings in a spirally wound condition. Both ends of the flat cable are directly or indirectly led out of the housings. As a means for indirectly leading the flat cable out of the housing, a connecting structure has been known such that conductors in the flat cable are connected to an outside lead wire via terminals of a lead block.

Hitherto, a method has been proposed for connecting conductors in a flat cable to a terminal of a lead block using ultrasonic welding. According to such a connecting method using ultrasonic welding, terminals of a lead block and conductors of a flat cable are placed on an anvil of an ultrasonic welding apparatus, and ultrasonic vibrations are applied by a horn to overlapping portions of the terminals and the conductors while being pressurized by the horn to cause solid-phase welding on connections between the terminals and the conductors. Since a plurality of terminal and conductor pairs are connected simultaneously, the method offers the advantages of a simple connecting operation and reducing operating time as compared with other connecting methods such as soldering and spot welding.

In recent years, the thicknesses of conductors in flat cables have been made thinner. For example, a flat cable having an extra-thin conductor of about 35 $\mu$m has appeared. In the case of ultrasonically welding such a thin conductor to a terminal, unless parallelism between the anvil of the ultrasonic welding apparatus and the horn is precisely controlled, the pressure of the horn does not act uniformly on the connection between the terminal and the conductor, so that solid-phase welding does not occur on the target section. Particularly, in the case of ultrasonically welding a plurality of conductors in a flat cable to corresponding terminals of a lead block simultaneously, connecting conditions for each conductor and terminal pair are likely to vary, and all conductor and terminal pairs cannot be securely connected.

SUMMARY OF THE INVENTION

Accordingly, it is an object of the present invention to provide a connecting structure between a flat cable and terminals in which projections are formed on sections of the terminals to which conductors are ultrasonically welded.

According to an aspect of the present invention, there is provided a connecting structure between a flat cable and terminals wherein a projection is formed on a flat terminal supported by a lead block, and the terminal and a conductor in the flat cable are ultrasonically welded through the projection.

The projection may be formed into any shape. For example, it may be formed into a hemispherical shape by half punching, or a trapezoidal shape in cross section by a thickness deviation process.

In addition, although the number of the terminals to which the conductors are ultrasonically welded is not specifically limited, a plurality of terminals are preferably provided on the lead block at predetermined pitches for effectively ultrasonically welding corresponding conductors of the flat cable to these terminals.

Further, portions of the conductors to be ultrasonically welded to the terminals, at least surfaces opposite to the terminals should be exposed. For example, the conductors may be completely exposed by removing base films of the flat cable, or one laminated base film may be stripped to expose the conductors on the other base film.

DESCRIPTION OF THE PREFERRED EMBODIMENT

A preferred embodiment will be described with reference to the accompanying drawings.

Figure 1:
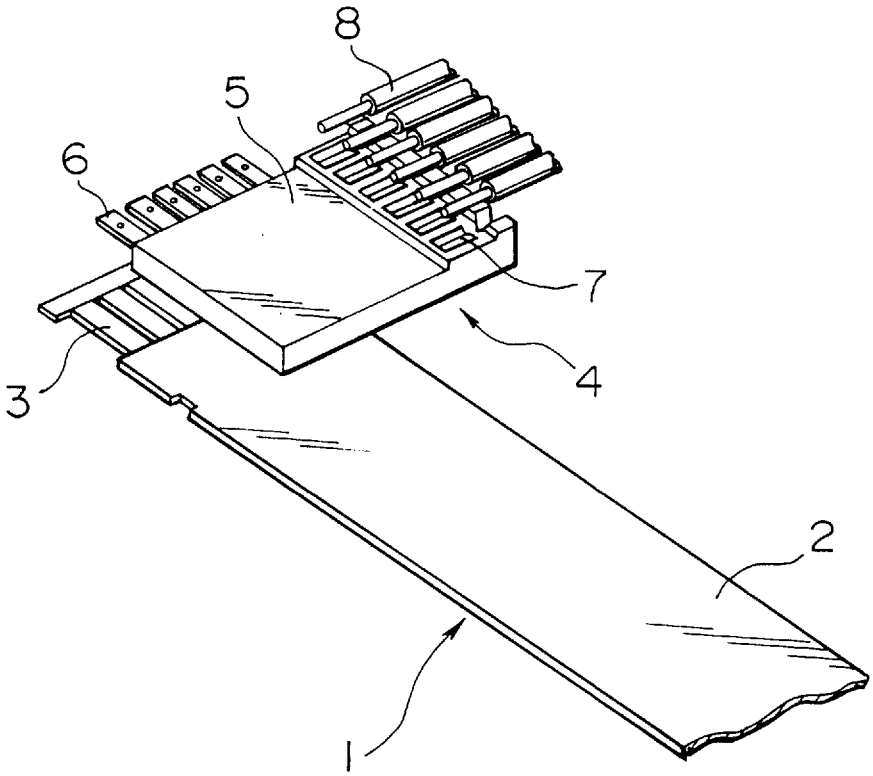
FIG. 1 is an exploded perspective view showing connections between a flat cable, lead block and lead wires.
Figure 2A:
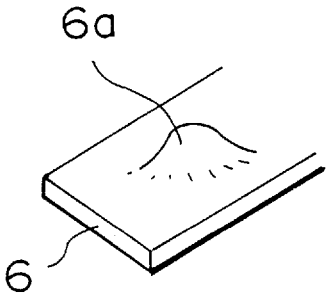
FIGS. 2A and 2B illustrate a projection of a terminal.
Figure 2B:
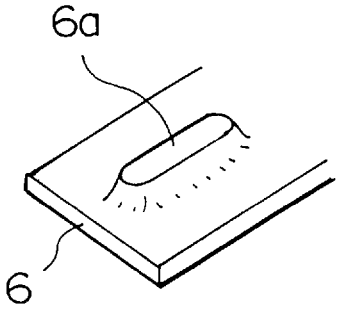

Referring to FIG. 1, a flat cable 1 comprises a pair of base films 2 formed of PET or the like, and a plurality of conductors 3 embedded in the base films 2 and formed of copper foils or the like each having a thickness of 35 $\mu$m. In this embodiment, six conductors 3 are employed. The base films 2 are removed from one end of the flat cable 1 to expose the conductors 3 at that section. A lead block 4 is molded by inserting a plurality of metal plates to a resin molded article 5. One end of each metal plate projects from the side face of the resin molded article 5 to form terminals 6, and the other end is exposed from the upper surface of the resin molded article 5 to form a connection 7. In this embodiment, six terminals are employed corresponding to the number of the conductors 3 in the flat cable 1 so that an arranged pitch of the terminals 6 coincides with that of the conductors 3. Each terminal has a projection 6*a* formed thereon, and shape and size of the projection 6*a* is suitably determined, such as a hemispherical shape shown in FIG. 2A due to half punching and a slim-trapezoidal shape shown in FIG. 2B due to a thickness deviation process.

Figure 3:
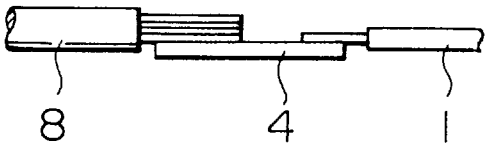
FIG. 3 illustrates a connecting condition of the flat cable, lead lock and a lead wire.

Referring to FIG. 3, conductors 3 in the flat cable 1 are connected to the terminals 6 of the lead block 4, and each lead wire 8 is connected to each connection 7 of the lead block 4 by spot welding or ultrasonic welding, whereby the flat cable 1 and each lead wire 8 are integrated through the lead block 4. The flat cable 1, the lead block 4 and the lead wires 8 thus integrated are used as electrical connecting means for a rotary connector, although this is not illustrated. The lead block 4 is fixed to a movable or a fixed housing, whereby the flat cable 1 stored in the housing is relayed by the lead wires 8 to be led out of the housing through the lead block 4.

Figure 4:
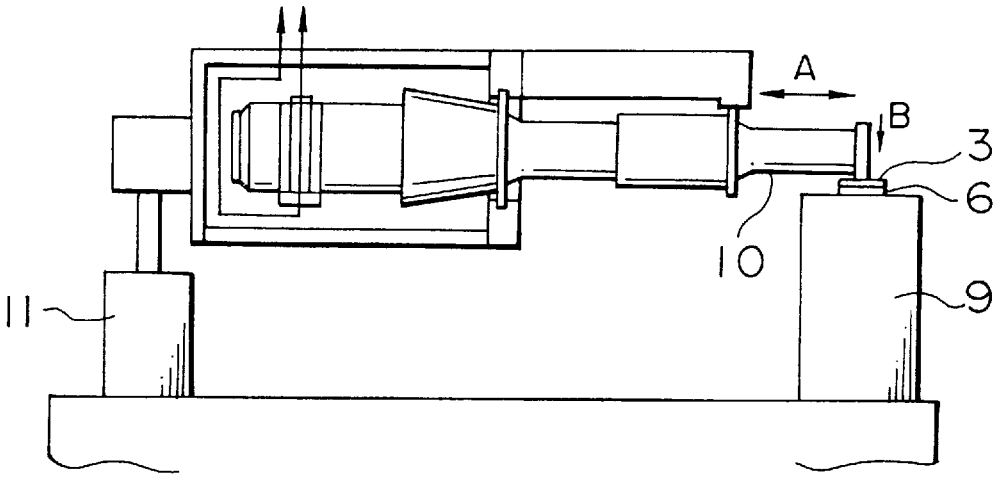
FIG. 4 illustrates a construction of an ultrasonic welding apparatus.
Figure 5:
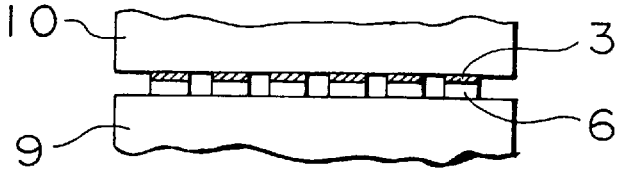
FIG. 5 illustrates a condition in which terminals and conductors are ultrasonically welded.

Referring to FIG. 4, an ultrasonic welding apparatus comprises an anvil 9 on which a workpiece is placed, a horn 10 for applying ultrasonic vibration in the direction of the arrow A to the workpiece, and an air cylinder 11 for rotating the horn 10 to apply a pressure in the direction of the arrow B to the work piece. In this embodiment, the conductors 3 and the terminals 6 correspond to the workpiece. In the case of ultrasonically welding the conductors 3 and the terminals 6, when the terminals 6 of the lead block 4 and the conductors 3 of the flat cable 1 overlap on the anvil 9, ultrasonic vibrations are applied by the horn 10 to the overlapping portions while pressurizing, and solid-phase welding occurs between the projections 6*a* of the terminals 6 and the conductors 3, whereby a plurality of terminal 6 and conductor 3 pairs are connected simultaneously. At this time, even if there is a little error in parallelism between the anvil 9 and the horn 10, the pressure of the horn 10 uniformly acts on the connections between the terminals 6 and the conductors 3 because they are connected through the projections 6*a*. Therefore, all terminal 6 and conductor 3 pairs can be securely ultrasonically welded.

The above-described effect becomes especially dominant when the thickness of each conductor 3 is 10 to 50 $\mu$m because ultrasonic welding can be smoothly performed without the projections 6*a* when the thickness of each conductor 3 exceeds 50 $\mu$m, and it is difficult to form a conductor 3 thinner than 10 $\mu$m.

According to the above-described embodiment, the present invention offers the following advantages:

Formation of the projections on the terminals cancels variations in pressure, which result in poor connection, so that the conductors and the terminals are securely ultrasonically welded. As a result, even if a flat cable having thin conductors is used, it becomes unnecessary to strictly control the parallelism between the anvil of the ultrasonic welding apparatus and the horn, so reduced operating time required for ultrasonic welding and simplified operation can be achieved.

In addition, when a plurality of terminals are provided on the lead block with a predetermined pitch, and the corresponding conductors of the flat cable are ultrasonically welded to the terminals, each terminal and conductor pair can be securely and simultaneously ultrasonically welded.

What is claimed is:

1. A connecting structure between a flat cable and terminals wherein a projection projected in a direction toward a conductor in the flat cable is formed on a flat terminal supported by a lead block, and said flat terminal and the conductor in the flat cable are ultrasonically welded through said projection, creating a welded section.

2. The connecting structure between a flat cable and terminals of claim 1, wherein a plurality of further flat terminals are provided on said lead block at predetermined intervals and wherein a plurality of further conductors are provided in said flat cable, and each of the flat terminals and each of the conductors in said flat cable are simultaneously ultrasonically welded through further projections, creating further welded sections.

3. The connecting structure between a flat cable and terminals of claim 2, wherein a side of the conductors in said flat cable which is not opposed to said flat terminals is supported by a base film at the welded sections of said conductors and said flat terminals.

4. The connecting structure between a flat cable and terminals of claim 1, wherein a side of the conductor in said flat cable which is not opposed to said flat terminal is supported by a base film at the welded section of said conductor and said flat terminal.

5. A rotary connector, comprising:

a pair of housings connected so as to be rotatable relative to each other;

a flat cable stored in said housings in a spirally wound condition, said flat cable comprising a first and a second end;

a leading section provided on either of said pair of housings through which the first end of said flat cable is electrically led out of the housings, wherein said leading section is provided with a lead block, a projection is formed on a flat terminal supported by said lead block, and said flat terminal and a conductor in said flat cable are ultrasonically welded through said projection, creating a welded section.

6. The rotary connector of claim 5, wherein a plurality of further flat terminals are provided on said lead block at predetermined intervals and wherein a plurality of further conductors are provided in said flat cable, and each of the flat terminals and each of the conductors in said flat cable are simultaneously ultrasonically welded through further projections creating further welded sections.

7. The rotary connector of claim 6, wherein a side of the conductor in said flat cable which is not opposed to said flat terminal is supported by a base film at the welded sections of said conductors and said flat terminals.

8. The rotary connector of claim 6, wherein said conductors in said flat cable are connected to first ends of said flat terminals of said lead block by welding, and a lead wire is connected to second ends of said flat terminals and led out of said housings.

9. The rotary connector of claim 5, wherein a side of the conductor in said flat cable which is not opposed to said flat terminal is supported by a base film at the welded section of said conductor and said terminal.

10. The rotary connector of claim 9, wherein said conductor in said flat cable is connected to a first end of said flat terminal of said lead block by welding, and a lead wire is connected to a second end and led out of said housings.

11. The rotary connector of claim 5, wherein said conductor in said flat cable is connected to the first end of said flat terminal of said lead block by welding, and a lead wire is connected to the second end and led out of said housings.

* * * * *